United States Patent [19]

Kondo

[11] 4,269,025

[45] May 26, 1981

[54] ELECTRONIC ALARM TIMEPIECE WITH PRESETTABLE ALARM TIME MEMORY

[75] Inventor: Kenichi Kondo, Tokyo, Japan

[73] Assignee: Kabushiki Kaisha Daini Seikosha, Tokyo, Japan

[21] Appl. No.: 921,466

[22] Filed: Jul. 3, 1978

[30] Foreign Application Priority Data

Jul. 20, 1977 [JP] Japan ..... 52-87113

[51] Int. Cl.[2] ..... G04C 21/00

[52] U.S. Cl. ..... 368/73; 368/106; 368/108; 368/251

[58] Field of Search ..... 58/16 R, 16 D, 39.5, 58/22.9, 19 R, 38 R, 57.5, 152 B

[56] References Cited

U.S. PATENT DOCUMENTS 4,074,516 2/1978 Kondo ..... 58/38 R 4,095,410 6/1978 Kaneko ..... 58/38 R 4,107,916 8/1978 Kondo ..... 58/38 R

*Primary Examiner*—J. V. Truhe

*Assistant Examiner*—John B. Conklin

*Attorney, Agent, or Firm*—Robert E. Burns; Emmanuel J. Lobato; Bruce L. Adams

[57] ABSTRACT

An electronic alarm timepiece has a time counter, an alarm time memory circuit and a coincidence detector for detecting a coincidence between the time count and the stored alarm time for actuating an alarm. The alarm time memory circuit is a presettable counter and it is presettable to load the present time count in the time counter therein. In this way, a coarse adjustment of the alarm time can be set and a manually operable mechanism is provided to increment the count in the alarm time memory circuit to obtain the precise desired alarm time.

5 Claims, 1 Drawing Figure

OSCILLATING CIRCUIT
DIVIDING CIRCUIT
TIME COUNTING CIRCUIT
1
2
3
SW1
VDD
Vss1
20
21
10
CL
R
S
4
ALARM TIME MEMORY CIRCUIT
SW2
VDD
Vss1
22
9
24
23
SW3
Vss1
VDD
8
COINCIDENCE CIRCUIT
13
12
28
26
25
27
11
5
DECODER
6
DRIVING CIRCUIT
7
DISPLAY

ELECTRONIC ALARM TIMEPIECE WITH PRESETTABLE ALARM TIME MEMORY

BACKGROUND OF THE INVENTION

The present invention relates to electronic alarm timepieces which generate alarms at the time when the alarms are set.

Since digital electronic timepieces can be multi-functioned more easily than analogue electronic timepieces, electronic alarm timepieces of the digital type have come into general use by their capacity for generating the alarms at the proper alarm time in a optimum size, and with low cost.

The types of the conventional electronic alarm timepieces can be roughly divided into two; namely electronic alarm timepieces which generate the alarm once a day in which the content of the alarm time memory circuits are reset when the alarms are generated at the alarm time, and every day electronic alarm timepieces in which alarm time memory circuits are not reset even if the alarm is generated, but the alarms are driven at the set time every day. These two kinds of electronic alarm timepieces respectively have advantages and disadvantages as follows. Namely, the electronic alarm timepieces which generate the alarm once a day are inconvenient with respect to the operability since the alarm times are reset once the alarm is generated, therefore, when the alarm times are set again, hour, minute and figure must be set again by a switching operation. While with respect to the everyday electronic alarm timepieces, the alarm time memory circuits must be reset in case the alarms are not necessary and if necessary, the alarms must be set again. Thus, since the conventional electronic alarm timepieces require various kinds of switching operations, the electronic alarm timepieces provided with the simple switching mechanisms are expected.

On the other hand, since the conventional electronic alarm timepieces are provided with only one function, the function doesn't work well when the alarms are not necessary.

SUMMARY OF THE INVENTION

An object of the present invention is to simplify the switching operation by judging whether the expected alarm time is newly set after resetting the contents of the alarm time memory circuit or after setting the present time.

Another object of the present invention is to provide a memory function which memorizes the present time necessary in case the alarm is not necessary, thereby eliminating the above mentioned conventional disadvantages.

BRIEF DESCRIPTION OF THE INVENTION

FIG. 1 is a circuit diagram showing an embodiment of the present invention.

DETAILED DESCRIPTION OF THE INVENTION

Figure 1:
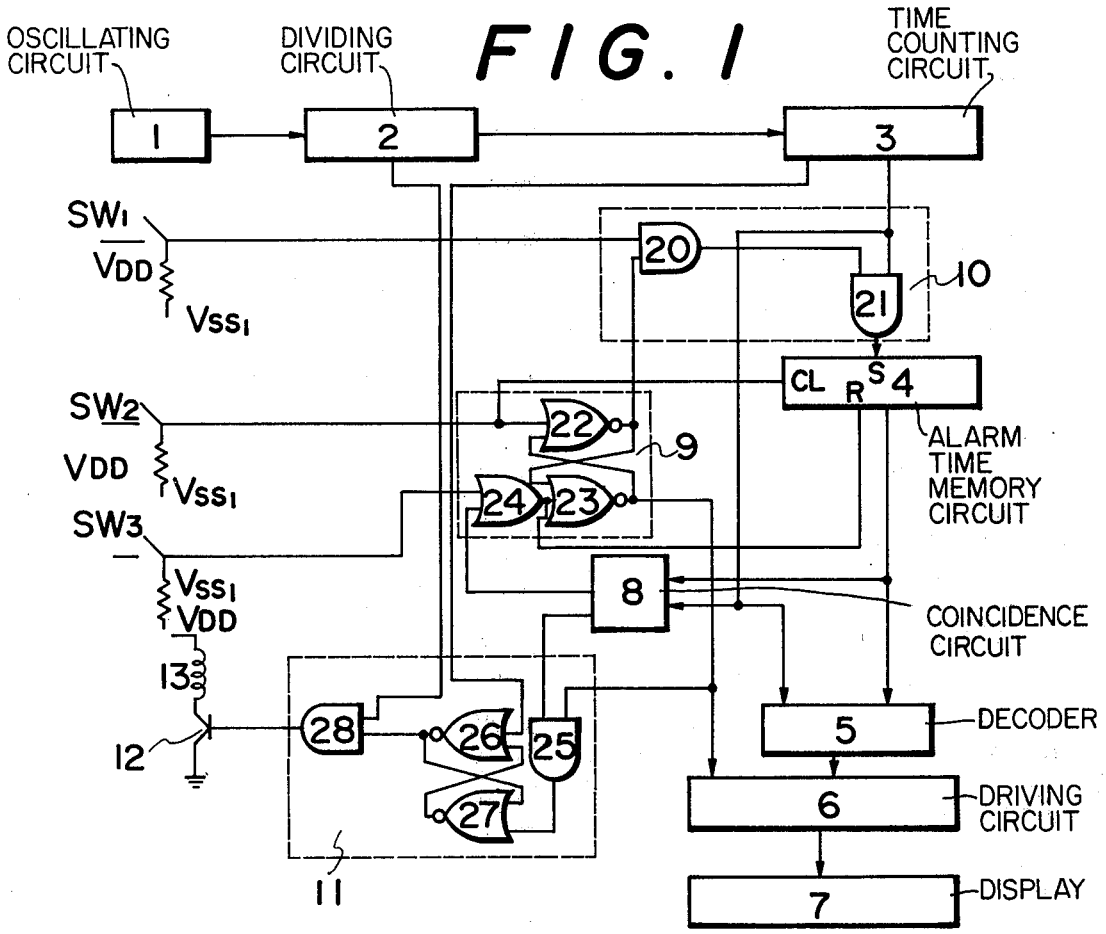

FIG. 1 is an embodiment of the present invention, wherein an oscillating circuit 1 oscillates to produce signals to act as reference signals, and a dividing circuit oscillating 2 divides the oscillating signals. 1 Hz signals of the dividing circuit 2 are fed to a time counting circuit 3 as time counting signals to thereby count the time.

An alarm time memory circuit 4 memorizes the alarm time, a decoder 5 converts the BCD signals of the time counting circuit 3 and the alarm time memory circuit 4 into display segment signals, a driving circuit 6 minute drives an hour and time on a display device 7, a coincidence detecting circuit 8 detects the coincidence of the time counting circuit 3 and the alarm time memory circuit 4, an alarm controlling circuit 11 controls an alarm 13, an alarm driving circuit 12 drives the alarm 13, a memory that circuit 9 memorizes the alarm time memory circuit 4 is in the set condition, a transmission gate circuit 10 sets the time content of the time counting circuit 3 in the alarm time memory circuit 4 by a switching instruction, a switch SW1 is an operation switch which effects memorization of the present time, a switch SW2 is a switch to set the alarm time by feeding a set pulse signal in the alarm time memory circuit 4, a switch SW3 is a reset switch which resets the alarm time memory circuit 4 at any time.

Hereafter the circuit operation of the above mentioned construction will be illustrated.

A pulse signal is fed to the alarm time memory circuit 4 by the ON-OFF operation of the switch SW2, and thereby the alarm time can be set. The pulse signal is fed to the memory circuit 9 composed of an R-S flip-flop circuits of NOR circuit comprised 22 and 23 and sets the output from the NOR circuit 23 at "1" and memorizes the alarm memory set condition. When the time counting circuit 3 and the alarm time memory circuit 4 coincide, the coincidence signal is produced from the coincidence circuit 8 and is fed to a NOR circuit 27 of the alarm controling circuit 11 via an AND circuit 25, and then a NOR circuit 26 of the R-S flip-flop circuit composed of the NOR circuits 26 and 27 is set in the "1" condition, and thereby the dividing circuit 2 of the audible frequency from 2 to 6 KHz is fed to the base of the alarm driving circuit 12 via an AND circuit 28 from the dividing circuit 2 to drive the alarm 13. Since a 1/10 second or a 1/20 Hz signal produced from the time counting circuit 3 is fed to the NOR circuit 26 to thereby reset the R-S flip-flop, the output from the NOR circuit 26 becomes under "0" condition and the alarm automatically stops after 10 or 20 seconds. When the coincidence occurs, a delayed reset pulse is generated and is fed to the NOR circuit 23 of the memory circuit 9 via an OR circuit 24, and thereby the output from the NOR circuit 23 is reset to "0". The alarm time of the alarm time memory circuit 4 is reset by the delayed reset pulse. In case the alarm is used every day, the NOR circuit 24 is omitted lest the alarm time should reset by the delayed reset pulse signal and the circuit is connected so that the alarm time memory circuit 4 is reset only by the ON-OFF operation of the switch SW3.

The storage of the present time is now referred to for the disclosed circuit of the invention.

When the alarm time memory circuit 4 is in the reset condition, the output from the NOR circuit 22 of the memory circuit 9 is kept at "1", and the pulse signal produced by the ON-OFF operation of the switch SW1 enables the AND circuit 21 of the transmission gate 10 via AND circuit 20 and is fed to the set input terminals of the alarm time memory circuit 4 and thereby the present time from counting circuit 3 is memorized. The output of the NOR circuit 23 of the memory circuit 9 is at "0" and the signal doesn't set the alarm time but clearly indicates that the alarm is in the reset condition or the present time is memorized on the display device 7.

By the above mentioned construction, when the alarm time is set again or the alarm time is changed, the method to set the alarm time, i.e. whether the alarm time is set after resetting the alarm time or memorizing the present time, can be freely chosen. As a result, the electronic alarm timepiece according to the present invention is free from the inconvenience of the switching operation and a functional electronic alarm timepiece can be provided. Furthermore, the present time can be memorized by a one touch operation where it is desired to memorize the time when an accident happens, or to investigate waiting time or the passage of time. Thus, according to the present invention, a very convenient electronic alarm timepiece can be provided.

I claim:

1. An electronic alarm timepiece comprising: an oscillating circuit for producing a time standard signal; a time counter for counting the time standard signal; an alarm time memory circuit; a display device for displaying the alarm time and the time count; an actuatable alarm device; a coincidence detector for detecting a coincidence between the time count and the memorized alarm time to produce a signal for actuating the alarm device; and means for effecting memorization of the present time count in the alarm time memory circuit to preset same for the later setting to a desired alarm time.

2. The timepiece according to claim 1; wherein the alarm time memory circuit comprises a presettable counter; and further comprising manually operable means for supplying at least one pulse to the alarm time memory circuit to increment same to a desired alarm time.

3. In an electronic alarm timepiece having a time counter, an alarm time memory circuit and means for comparing the time count and the alarm time for actuating an alarm, the improvement wherein the alarm time memory circuit comprises a presettable counter; and further comprising first manually actuatable means for producing a single pulse to effect the presetting of the present time count in the time counter into the alarm time memory circuit.

4. In the timepiece according to claim 3; the improvement further comprising second manually operable means for supplying at least one setting pulse to the alarm time memory circuit for incrementing same to a desired alarm time setting.

5. In the timepiece according to claim 4; the improvement further comprising third manually operable means for producing a resetting pulse for resetting the alarm time memory circuit; and an alarm time setting circuit responsive to the first setting pulse from the second manually operable means for placing same in a first condition to enable actuation of the alarm upon a favorable comparison by the comparing means and responsive to a resetting pulse from the third manually operable means for placing same in a second condition wherein the alarm is disabled and the first manually operable means is enabled to preset the present time into the alarm time memory circuit.

* * * * *